US011447927B2

(12) United States Patent
Harshman et al.

(10) Patent No.: US 11,447,927 B2
(45) Date of Patent: Sep. 20, 2022

(54) SUPPORT ASSEMBLY FOR A GRADING MACHINE

(71) Applicant: Caterpillar Inc., Peoria, IL (US)

(72) Inventors: Nathaniel K. Harshman, Sullivan, IL (US); Davida R. Reang, Forsyth, IL (US); Benjamin J. Kovalick, Decatur, IL (US)

(73) Assignee: Caterpillar Inc., Peoria, IL (US)

( * ) Notice: Subject to any disclaimer, the term of this patent is extended or adjusted under 35 U.S.C. 154(b) by 353 days.

(21) Appl. No.: 16/558,862

(22) Filed: Sep. 3, 2019

(65) Prior Publication Data

US 2021/0062461 A1 Mar. 4, 2021

(51) Int. Cl.
*E02F 3/76* (2006.01)
*E02F 3/84* (2006.01)

(52) U.S. Cl.
CPC ..... *E02F 3/7668* (2013.01); *E02F 3/844* (2013.01)

(58) Field of Classification Search
CPC ..... E02F 3/7663; E02F 3/7668; E02F 3/786; E02F 3/844
See application file for complete search history.

(56) References Cited

U.S. PATENT DOCUMENTS 2,034,141 A * 3/1936 Gustafson ..... E02F 3/7636 172/785
4,622,860 A * 11/1986 Cametti ..... F16C 19/30 74/448
5,720,353 A * 2/1998 Wilkening ..... E02F 3/8157 172/747
6,851,485 B2 2/2005 Maeda et al.
7,575,068 B2 8/2009 Stubben
7,926,583 B2 * 4/2011 Newnam ..... E02F 3/815 172/684.5
8,464,803 B2 6/2013 Greuel et al.
9,103,100 B2 * 8/2015 Harris ..... E02F 3/765
9,394,944 B2 * 7/2016 Bienfang ..... E02F 3/46
9,506,219 B2 * 11/2016 Bienfang ..... E02F 9/123
9,587,677 B2 * 3/2017 Roelofsen ..... F16C 43/04
2008/0110651 A1 * 5/2008 Stubben ..... E02F 3/7645 172/781
2011/0247845 A1 * 10/2011 Greuel ..... E02F 9/123 172/677
2015/0135866 A1 * 5/2015 Staade ..... F16H 57/029 74/89.18
2019/0112782 A1 4/2019 Gundupalli
2021/0062908 A1 * 3/2021 Harshman ..... E02F 3/80

FOREIGN PATENT DOCUMENTS

IN 201621020427 A 12/2017

* cited by examiner

*Primary Examiner* — Jessica H Lutz
(74) *Attorney, Agent, or Firm* — Bookoff McAndrews, PLLC

(57) ABSTRACT

A grading machine includes a machine body, a blade assembly, a circle supporting the blade assembly and including a plurality of teeth, a drawbar assembly connecting the circle to the machine body, and a cover plate coupled to a bottom portion of the drawbar assembly. The drawbar assembly includes a plurality of blocks, and the cover plate is configured to be coupled to the drawbar assembly via the plurality of blocks.

20 Claims, 3 Drawing Sheets

SUPPORT ASSEMBLY FOR A GRADING MACHINE

TECHNICAL FIELD

The present disclosure relates generally to grading machines, and more particularly, to a support assembly for a grading machine.

BACKGROUND

The present disclosure relates to mobile machines that are used in grading. Grading machines, such as motor graders, are typically used to cut, spread, or level material that forms a ground surface. To perform such earth sculpting tasks, grading machines include a blade, also referred to as a moldboard or implement. The blade moves relatively small quantities of earth from side to side, in comparison to a bulldozer or other machine that moves larger quantities of earth. Grading machines are frequently used to form a variety of final earth arrangements, which often require the blade to be positioned in different positions and/or orientations depending on the sculpting task and/or the material being sculpted. The blade is supported and positioned by various components, including a drawbar and a circle. The circle may be rotated relative to the drawbar in order to adjust a blade angle, for example, via a circle drive pinion engaging with teeth on the circle to rotate the circle. Debris, such as dirt, rocks, or grease, may accumulate and/or damage the circle teeth and/or the circle drive pinion. Covering the circle teeth and/or the circle drive pinion may reduce the likelihood of damage, but may increase the weight of the grading machine and/or may impede the ability to inspect, repair, and/or replace the circle teeth, the circle drive pinion, or other components of the machine.

U.S. Patent Application Publication No. 2015/0135866, published on May 21, 2015 ("the '866 publication"), describes a sealed guard for a motor grader. The '866 publication includes a circle having a circle gear connected to a frame for rotation relative to the draft frame. A circle drive mounted to the draft frame may include a pinion engaging the circle gear to rotate the circle relative to the draft frame. The guard of the '866 publication may provide a radial cover of the circle gear and the pinion. The guard may be, for example, sheet metal. A seal may provide a sealed connection between the guard and the circle. However, the guard of the '866 publication may not effectively seal the circle teeth from debris, may become dented or damaged due to debris (e.g., rocks) striking or colliding with the guard, and/or may impede an operator's ability to inspect, repair, and/or replace the circle teeth, the circle drive pinion, or other components of the machine.

The support assembly for a grading machine of the present disclosure may solve one or more of the problems set forth above and/or other problems in the art. The scope of the current disclosure, however, is defined by the attached claims, and not by the ability to solve any specific problem.

SUMMARY

In one aspect, a grading machine may include a machine body, a blade assembly, a circle supporting the blade assembly and including a plurality of teeth, a drawbar assembly connecting the circle to the machine body, and a cover plate coupled to a bottom portion of the drawbar assembly. The drawbar assembly may include a plurality of blocks, and the cover plate may be configured to be coupled to the drawbar assembly via the plurality of blocks.

In another aspect, a grading assembly may include a drawbar assembly, a circle having a plurality of circle teeth on an inward face, a blade assembly coupled to the circle, and a cover plate. The drawbar assembly may include a plurality of blocks on a inward face of the drawbar assembly. The cover plate may be coupled to the drawbar assembly via the plurality of blocks, and the cover plate may cover a circumferential gap between the circle and the drawbar assembly.

In yet another aspect, a drawbar assembly may include a drawbar, a yoke plate, a circular extension portion extending downward from the drawbar, and a plurality of blocks on an inward face of the extension portion.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Both the foregoing general description and the following detailed description are exemplary and explanatory only and are not restrictive of the features, as claimed. As used herein, the terms "comprises," "comprising," "has," "having," "includes," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus. For the purpose of this disclosure, the term "ground surface" is broadly used to refer to all types of surfaces or materials that may be worked in material moving procedures (e.g., gravel, clay, sand, dirt, etc.) and/or can be cut, spread, sculpted, smoothed, leveled, graded, or otherwise treated. In this disclosure, unless stated otherwise, relative terms, such as, for example, "about," "substantially," and "approximately" are used to indicate a possible variation of ±10% in the stated value.

Figure 1:
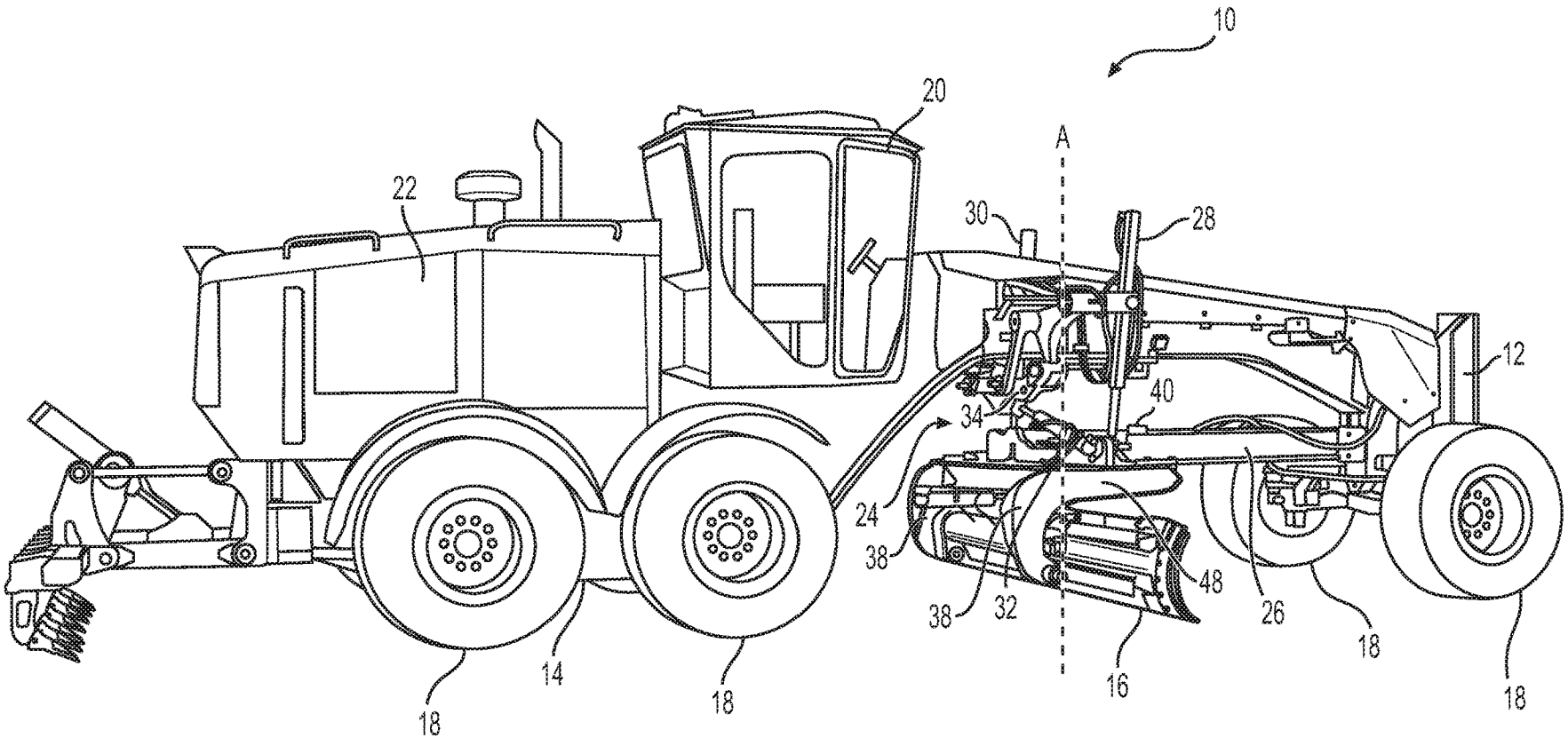
FIG. 1 is a perspective view of an exemplary grading machine, according to aspects of this disclosure.

FIG. 1 illustrates a perspective view of an exemplary motor grading machine 10 such as a motor grader, according to the present disclosure. Grading machine 10 includes a front frame 12, a rear frame 14, and a blade assembly 16. Front frame 12 and rear frame 14 are supported by wheels 18. An operator cab 20 may be mounted above a coupling of front frame 12 and rear frame 14. Rear frame 14 also includes an engine 22 to drive and/or power grading machine 10. Blade assembly 16 may include a blade, sometimes referred to as a moldboard, and is used to cut, spread, or level (collectively "sculpt") earth or other material traversed by grading machine 10. Blade assembly 16 is mounted on a linkage assembly, shown generally at 24. Linkage assembly 24 allows blade assembly 16 to be moved to a variety of different positions and orientations relative to grading machine 10, and thus sculpt the traversed ground surface in different ways. As discussed below, linkage assembly 24 includes a drawbar 26 and a circle 48. Circle 48 may be coupled to blade assembly 16, for example, via support arms 38 Additionally, a circle drive assembly 40 may include or be coupled to a motor, and circle drive assembly 40 may include a gearing arrangement in order to engage with and rotate circle 48 in order to adjust at least one aspect of blade assembly 16. The coupling and/or engagement of drawbar 26 and/or circle drive assembly 40 with circle 48 may be covered and/or protected by a cover plate 60 (FIGS. 2A, 2B, and 3).

Starting at the front of the grading machine 10 and working rearward toward the blade assembly 16, linkage assembly 24 includes drawbar 26. Drawbar 26 is pivotably mounted to the front frame 12 with a ball joint 36 (FIGS. 2A, 2B, and 3). The position of drawbar 26 may be controlled by hydraulic cylinders, including, for example, a right lift cylinder 28, a left lift cylinder 30, a centershift cylinder 32, and a linkbar 34. A height of blade assembly 16 with respect to the surface being traversed below grading machine 10 may be primarily controlled and/or adjusted with right lift cylinder 28 and left lift cylinder 30. Right lift cylinder 28 and left lift cylinder 30 may be controlled independently and, thus, may be used to tilt blade assembly 16. Right lift cylinder 28 and left lift cylinder 30 may also be used (e.g., extended or retracted simultaneously) to control the height of blade assembly 16 relative to grading machine 10 in order to control a depth of the cut into the ground surface or a height of blade assembly 16 above the ground surface. Centershift cylinder 32 and linkbar 34 may be used primarily to shift a lateral position of drawbar 26, and any components mounted to drawbar 26, relative to front frame 12.

Figure 2A:
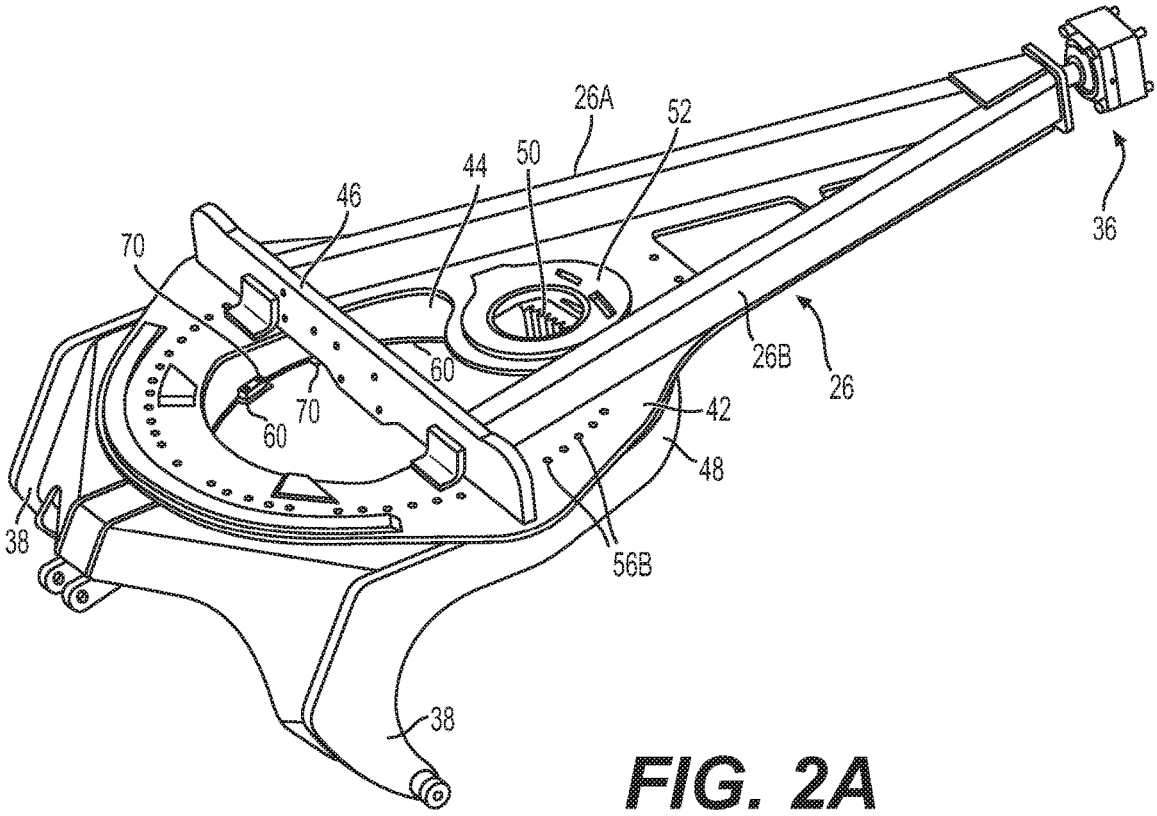
FIGS. 2A and 2B are perspective views of the top and bottom, respectively, of a blade support assembly of the grading machine of FIG. 1.
Figure 2B:
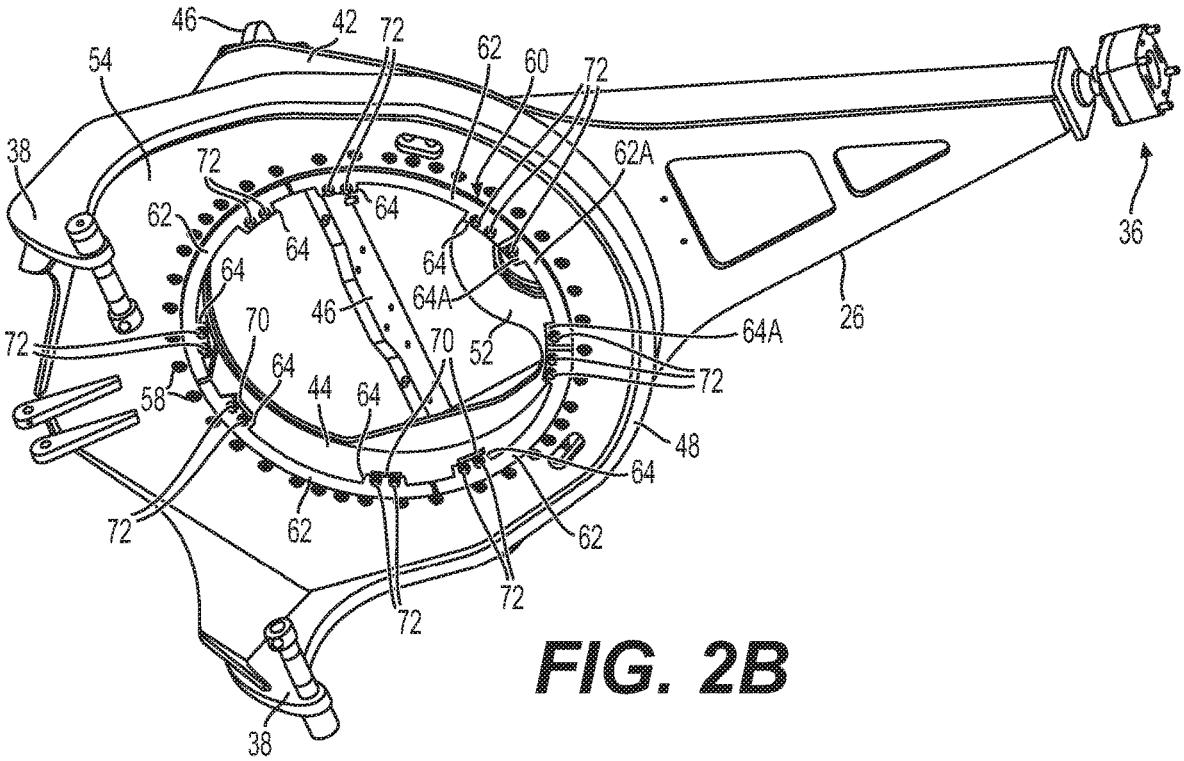
Figure 3:
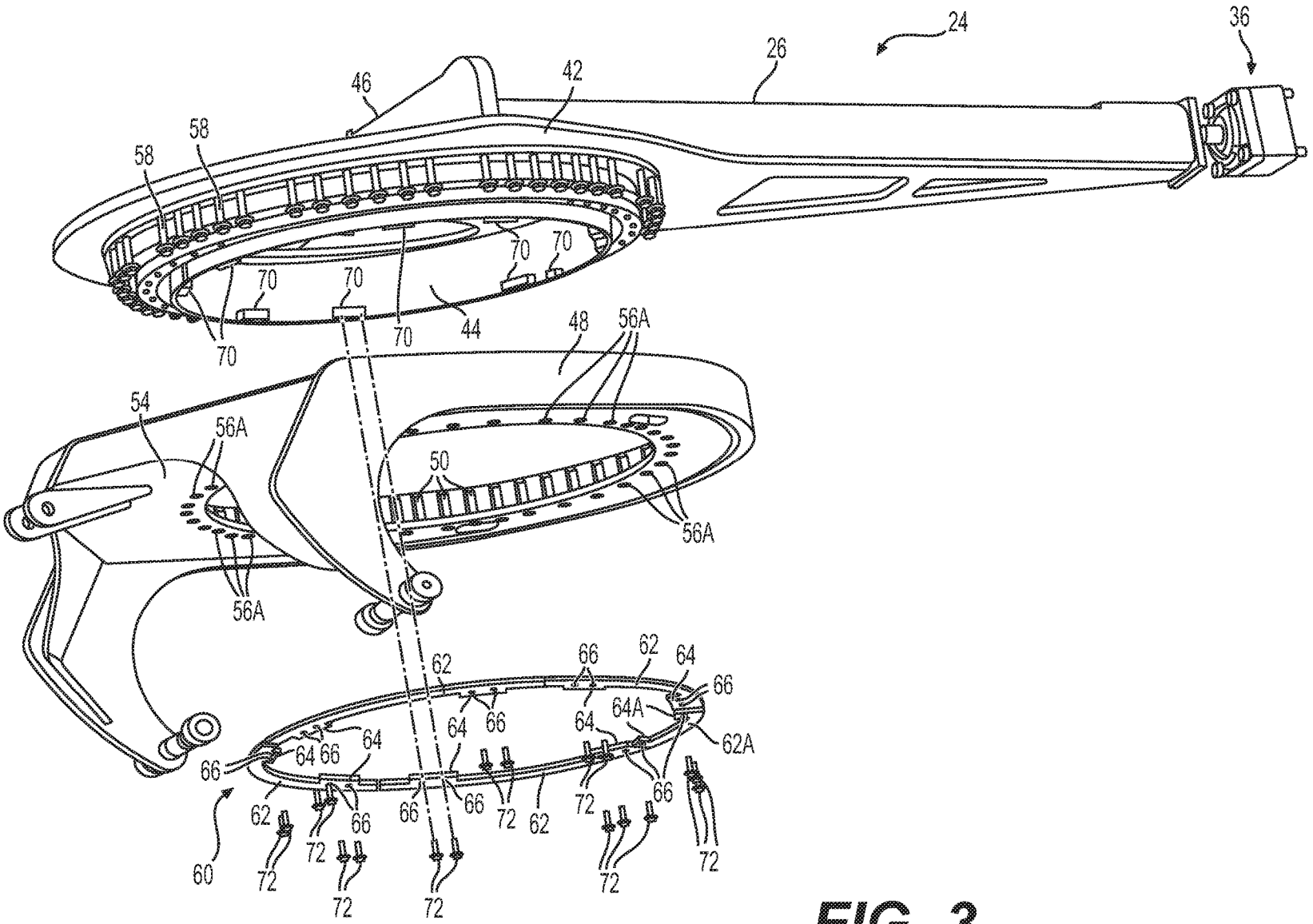
FIG. 3 is a partially exploded view of the blade support assembly.

As shown in FIGS. 2A and 2B, drawbar 26 is coupled to a large, flat plate, commonly referred to as a yoke plate 42. An extension 44 may extend below yoke plate 42, for example, downward from drawbar 26. Together, drawbar 26, yoke plate 42, and extension 44 may form a drawbar assembly. Extension 44 may be fixedly coupled to or otherwise extend from one or more of drawbar 26 and/or yoke plate 42. Extension 44 may be formed of a metallic material, and, for example, may be integrally formed with drawbar 26 and/or yoke plate 42 and/or welded or otherwise coupled to drawbar 26 and/or yoke plate 42. Additionally, a crossbeam 46 may connect drawbar arms 26A and 26B in order to support and/or brace drawbar 26 and components supported by drawbar 26 (e.g., circle 48, blade assembly 16, etc.) to receive forces as motor grader 10 traverses the ground surface.

Beneath yoke plate 42 is a large gear, commonly referred to as a circle 48. Circle 48 includes a plurality of teeth 50 that extend along an inner face of circle 48. For example, teeth 50 may extend along the entirety of the inner face of circle 48. Furthermore, yoke plate 42 may extend over an entirety of circle 48, for example, positioned above circle 48. Nevertheless, as shown in FIG. 2A, yoke plate 42 may include a central opening, which may reduce the weight of yoke plate 42 and/or allow for visual inspection of various components. Extension 44 may overlap with at least a portion of circle 48, for example, to help protect teeth 50 from debris (e.g., dirt, rocks, grease, etc.) that may accumulate and/or damage the teeth 50 and/or the circle drive pinion of circle drive system 40. Additionally, a bottom plate 54 may be positioned below circle 48, with bottom plate 54 being coupled to a portion of the drawbar assembly, for example, to yoke plate 42. In this aspect, bottom plate 54 may include a plurality of through-holes 56A, and yoke plate 42 may also include a plurality of through-holes 56B. A plurality of coupling elements 58 (e.g., studs, bolts, screws, or the like, which may include corresponding nuts or other coupling elements) may extend through through-holes 56A, 56B, which may be threaded, to couple bottom plate 54 to yoke plate 42. Moreover, bottom plate 54 may at least partially overlap with the bottom portion of circle 48 in order to sandwich or couple circle 48 to the drawbar assembly. In this manner, circle 48 may be rotated by circle drive system 40, with yoke plate 42, bottom plate 54, and the other components of the drawbar assembly remaining stationary relative to front frame 12.

Circle 48 and blade assembly 16 may be coupled via support arms 38 and a support plate (not shown). Circle 48, and thus blade assembly 16, may be rotated by circle drive system 40. Although not shown, circle drive system 40 may include a circle drive motor and a gear box to engage with and rotate circle 48, for example, via the circle drive pinion engaging with teeth 50. As shown in FIG. 2A, yoke plate 44 may include a circle drive mount 52 with an opening through which a portion of circle drive system 40 may extend to engage with teeth 50 on circle 48. The rotation of circle 48 by circle drive system 40 adjusts a circle angle and pivots blade assembly 16 about an axis A (FIG. 1) fixed to drawbar 26 to establish a blade cutting angle. The blade cutting angle is defined as the angle of blade assembly 16 relative to front frame 12, and the blade cutting angle may be controlled by a combination of the position of circle 48 and the position of drawbar 26.

Additionally, grading machine 10 may include cover plate 60, and cover plate 60 may be coupled to a bottom portion of the drawbar assembly such that cover plate 60 is positioned adjacent to a bottom portion of circle 48. Cover plate 60 may cover at least a portion of circle 48, for example, teeth 50. In this aspect, cover plate 60 may be coupled to drawbar 26, yoke plate 42, and/or extension 44. Cover plate 60 may help form a seal between circle 48 and drawbar 26, yoke plate 42, and/or extension 44. For example, cover plate 60 may help enclose circle 48, including teeth 50, to protect the other components debris, such as dirt, rocks, or grease, that may otherwise accumulate and/or damage the circle 48, teeth, 50, and/or a portion of circle drive system 40 (i.e., the circle drive pinion).

As shown in FIG. 2A, cover plate 60 may be coupled to one or more blocks 70. Blocks 70 may extend radially inward from an inward face of extension 44, and may receive one or more fasteners 72 (e.g., studs, bolts, screws, or the like, which may include corresponding nuts or other coupling elements) to couple cover plate 60 to blocks 70. Although not shown, in one aspect, blocks 70 may extend inwardly from an inner face of yoke plate 42, and/or extension 44 may be integrally formed with drawbar 26 or yoke plate 42.

FIG. 3 is an exploded view of a portion of linkage assembly 24. FIG. 3 shows drawbar 26, yoke plate 42, and extension 44. Circle 48 includes teeth 50 on the inner face of circle 48. Additionally, cover plate 60 may be coupled to one or more blocks 70. Cover plate 60 may include one or more plate portions 62, which may be partially circular and/or arc shaped such that plate portions 62 together form circular cover plate 60. Cover plate 60 may include a plurality of inward extensions 64, and inward extensions 64 may include one or more through-holes 66, for example, to receive one or more fasteners 72 and couple cover plate 60 to one or more blocks 70. Cover plate 60 may be approximately as wide or wider than a circumferential gap between a portion of the drawbar assembly (e.g., extension 44) and the circle in order to seal the circumferential gap, but not interfere with or otherwise interact with through-holes 56A or coupling elements 58. Inward extensions 64 may be approximately as wide or slightly wider than blocks 70. In one aspect, cover plate 60 may include two inward extensions 64 on each plate portion 62, for example, on ends of each inward extension 64. Accordingly, if cover plate 60 includes four plate portions 62, then cover plate 60 may include eight inward extensions 64. Each inward extension 64 may include one, two, three, or more through-holes 66 to receive a corresponding number of fasteners 72. In another aspect, cover plate 60 may include three or more inward extensions 64 on each plate portion 62. For example, each plate portion 62 may include an inward extension 64 on each end and in a central or middle portion of the respective plate portion 62. Coupling plate portions 62 to blocks 70 at the ends and/or in the middle of plate portions 62 may help to increase the rigidity of plate portions 62. Additionally, through-holes 66 may be threaded, which may aid in the coupling cover plate 60 to blocks 70.

As mentioned, cover plate 60 may include a plurality of plate portions 62, and plate portions 62 may be evenly sized, or may be unevenly sized. For example, cover plate 60 may include two plate portions 62, three plate portions 62, four plate portions 62, six plate portions 62, eight plate portions 62, etc. In another aspect, as shown in FIGS. 2B and 3, cover plate 60 may include four plate portions 62 spanning a majority of cover plate 60, and a circle drive plate portion 62A may span a portion of cover plate 60 below circle drive system mount 52. In this aspect, circle drive plate portion 62A may separately and removably cover the engagement of circle drive system 40 with circle 48 such that removing only circle drive plate portion 62A (e.g., via fasteners 72 through circle drive inward extensions 64A) would provide access to the engagement of circle drive system 40 with circle, for example, to inspect, repair, or replace one or more components. Similarly, an operator may selectively remove one or more plate portions 62, 62A in order to inspect, repair, or replace components in different areas.

Cover plate 60 may be formed of a metallic material, non-metallic material, or another appropriate material. For example, cover plate 60 may be formed of steel (e.g., 1720 steel). In another example, cover plate 60 may be formed of a plastic or rubber material, which may deform as cover plate 60 is secured to blocks 70 to aid in forming a seal between circle 48 and extension 44. In either aspect, cover plate 60 may be approximately five to twenty-five millimeters thick (from top to bottom).

A plurality of blocks 70 may be coupled to extension 44. For example, the number and/or position of blocks 70 may correspond to the number and/or position of plate portions 62 and the corresponding plate extensions 64. In one aspect, blocks 70 may be positioned at any angular spacing. For example, each plate portion 62 may include one inward extension 64 on each end of each plate portion to reach receive one fastener 72, and blocks 70 may be positioned in in order to correspond to size and/or arc length of plate portions 62. Blocks 70 may extend from a bottom portion of extension, for example, blocks 70 may be only a portion of a height of extension 44. Although not shown, blocks 70 may include a corresponding number of through-holes, which may also be threaded to aid in coupling cover portions 62 to blocks 70. Additionally, one or more of blocks 70 may receive fasteners 72 to couple more than one inward extension 64 to one of blocks 70. For example, one block 70 may be coupled to an inward extension 64 of a plate portion 62 and also to circle drive inward extension 64A of circle drive plate portion 62A.

Blocks 70 may be formed of a metallic material, for example, a steel and/or the same material of drawbar 26, yoke plate 42, and/or extension 44. In one aspect, blocks 70 may be welded (e.g., tack welded) to extension 44. Alternatively, blocks 70 may be integrally formed with extension 44 (e.g., via casting, embossing, etc.). Furthermore, blocks 70 may be bolted to extension 44, or blocks 70 may be snap-fit to extension 44.

INDUSTRIAL APPLICABILITY

The disclosed aspects of grading machine 10 may be used in any grading or sculpting machine to support and/or protect various components of grading or sculpting machine. The aspects disclosed herein may help to provide a strong and durable connection between cover plate 60 and the drawbar assembly, which may help to protect teeth 50 of circle 48 and circle drive system 40. Additionally, the aspects disclosed here may allow for easy access to one or more portions of teeth 50 of circle 48 or circle drive system 40, which may allow for efficient, safe, and/or cost-effective inspection, repair, or replacement of various components. Therefore, the aspects disclosed herein may be reliable and low cost, without sacrificing performance.

Blocks 70 may be welded to a portion of the drawbar assembly, for example, to yoke plate 42 or extension 44. In this aspect, blocks 70 may allow for cover plate 60 to be coupled to the drawbar assembly, and one or more portions of the drawbar assembly (e.g., yoke plate 42 or extension 44) may be thinner than if cover plate 60 was directly attached to a portion of the drawbar assembly. As such, one or more portions of the drawbar assembly may be smaller and/or lighter, which may reduce the total size, weight, and/or cost of the drawbar assembly and/or grading machine 10. Furthermore, blocks 70 may be coupled to yoke plate 42 or extension 44 after production and/or assembly of the drawbar assembly, for example, to retro-fit an existing machine and/or not requiring a separate formation process.

Cover plate 60 may help to protect circle 48, teeth 50, and/or circle drive system 40 from debris, such as dirt, rocks, or grease, that may otherwise accumulate and/or damage the circle 48, teeth, 50, and/or a portion of circle drive system 40 (i.e., the circle drive pinion). When cover plate 60 is coupled to blocks 70, circle 48 and blade assembly 16 may rotate based on action of circle drive system 40, and cover plate 60 and the drawbar assembly (including drawbar 26, yoke plate 42, bottom plate 54, etc.) may remain stationary relative the front frame 12. Cover plate 60 may be thin (e.g., approximately five to twenty-five millimeters thick), and may be formed of steel or another durable material. As such, cover plate 60 may not significantly increase a size, weight, and/or cost of grading machine 10. Moreover, an operator may attach cover plate 60 to blocks 70 for operation, and may then remove cover plate 60 to inspect, repair, or replace a portion of circle 48, teeth, 50, and/or a portion of circle drive system 40 (i.e., the circle drive pinion). As mentioned, cover plate 60 may be thin and/or flat, and may thus allow for freedom of movement of blade assembly 16 or circle 48 during a grading procedure.

Plate portions 62, 62A may be separately coupled to one or more blocks 70. Accordingly, individual plate portions 62, 62A or subsets of plate portions 62, 62A may be removed in order to inspect, repair, or replace a portion of circle 48, teeth, 50, and/or a portion of circle drive system 40 (i.e., the circle drive pinion). Once the inspection, repair, or replacement is complete, the operator may then reattach the plate portion(s) 62, 62A to respective blocks 70, for example, via fasteners 72, and initiate or continue a grading procedure. The removable connection of cover plate 60 to blocks 70 via fasteners 72 may also help to minimize downtime and/or reduce the likelihood for damage to additional components or injury to the operator during the inspection, repair, or replacement procedure. Moreover, with cover plate 60 being circular (and plate portions 62, 62A being partially circular) and coupled to blocks 70, the central portion of circle 48, drawbar 28, yoke plate 42, extension 44, crossbeam 46, etc., is open and/or unobstructed, which may help to reduce the overall weight and/or cost of the drawbar assembly and of grading machine 10, while also increasing the visibility of the components without the need to remove or disconnect components.

It will be apparent to those skilled in the art that various modifications and variations can be made to the disclosed machine without departing from the scope of the disclosure. Other embodiments of the machine will be apparent to those skilled in the art from consideration of the specification and practice of the support assembly for a grading machine disclosed herein. It is intended that the specification and examples be considered as exemplary only, with a true scope of the disclosure being indicated by the following claims and their equivalents.

What is claimed is:

1. A grading machine, comprising:

a machine body;

a blade assembly;

a circle supporting the blade assembly, wherein the circle includes a plurality of teeth;

a drawbar assembly connecting the circle to the machine body; and a cover plate coupled to a bottom portion of the drawbar assembly, wherein the drawbar assembly includes a plurality of blocks, wherein the cover plate is configured to be coupled to the drawbar assembly via the plurality of blocks, and wherein the cover plate covers a circumferential gap between a portion of the drawbar assembly and the circle.

2. The grading machine of claim 1, wherein the cover plate includes a plurality of inward extensions that at least partially overlap with the blocks of the drawbar assembly when the cover plate is coupled to the drawbar assembly.

3. The grading machine of claim 2, wherein the cover plate includes a plurality of plate portions.

4. The grading machine of claim 3, wherein the plurality of plate portions each include respective ones of the plurality of inward extensions on ends of the plate portions.

5. The grading machine of claim 4, wherein each inward extension includes at least one threaded through-hole, and wherein the grading machine includes a plurality of fasteners extending through the threaded through-holes and into the blocks to secure the plate portions to the drawbar assembly.

6. The grading machine of claim 1, further comprising a circle drive system for rotating the circle relative to the drawbar assembly, wherein the circle drive system engages with at least one of the circle teeth to rotate the circle, and wherein the cover plate includes a circle drive plate portion configured to cover at least a portion of the engagement between the circle drive assembly and the circle teeth.

7. The grading machine of claim 1, wherein the drawbar assembly includes a drawbar, a yoke plate, and an extension extending downward from the drawbar, and wherein the blocks are positioned on an inward face of the extension.

8. The grading machine of claim 7, wherein the blocks are welded to the inward face of the extension.

9. The grading machine of claim 1, wherein the cover plate is formed of steel and is approximately five to twenty-five millimeters thick.

10. A grading assembly, comprising:

a drawbar assembly, wherein the drawbar assembly includes a plurality of blocks on an inward face of the drawbar assembly;

a circle having a plurality of circle teeth on an inward face of the circle;

a blade assembly coupled to the circle; and a cover plate, wherein the cover plate is coupled to the drawbar assembly via the plurality of blocks, and wherein the cover plate covers a circumferential gap between the circle and the drawbar assembly.

11. The grading assembly of claim 10, wherein the drawbar assembly includes a drawbar, a yoke plate, and an extension extending downward from the drawbar, and wherein the blocks are positioned on an inward face of the extension.

12. The grading assembly of claim 11, wherein the blocks are welded to the inward face of the extension.

13. The grading assembly of claim 11, wherein the yoke plate includes a circle drive system mount with an opening extending through the yoke plate configured to receive a circle drive assembly for rotating the circle relative to the drawbar assembly, and wherein the cover plate includes a circle drive plate portion configured to cover at least a portion of an engagement between the circle drive assembly and the circle teeth.

14. The grading assembly of claim 10, wherein the cover plate includes a plurality of plate portions, and wherein each plate portion includes one or more inward extensions that at least partially overlap with the blocks on the inward face of the drawbar assembly.

15. The grading assembly of claim 14, wherein the blocks each include one or more through-holes, wherein the one or more inward extensions each include one or more through-holes to couple the plate portions to the blocks.

16. A drawbar assembly, comprising:

a drawbar;

a yoke plate;

a circular extension portion extending downward from the drawbar;

a plurality of blocks on an inward face of the circular extension portion; and a circular cover plate, wherein the circular cover plate includes a plurality of inner extensions with through-holes to couple the circular cover plate to the blocks, wherein the circular cover plate covers a circumferential gap between the circular extension portion and a circle coupled to the drawbar assembly.

17. The drawbar assembly of claim 16, wherein the drawbar, the yoke plate, and the circular extension portion are integrally formed.

18. The drawbar assembly of claim 16, wherein the blocks are welded to the inward face of the circular extension portion.

19. The drawbar assembly of claim 16, wherein the yoke plate includes a circle drive system mount with an opening extending through the yoke plate configured to receive a circle drive assembly for rotating the circle relative to the drawbar assembly, and wherein the cover plate includes a circle drive plate portion configured to cover at least a portion of an engagement between the circle drive assembly and a plurality of circle teeth on an inward face of the circle.

20. The drawbar assembly of claim 16, wherein the circular extension portion extends downward from the yoke plate towards a bottom plate of the circle.

* * * * *